US007309185B2

(12) United States Patent
Thorpe et al.

(10) Patent No.: US 7,309,185 B2
(45) Date of Patent: Dec. 18, 2007

(54) TWIST UP PEN TYPE DISPENSER WITH BRUSH APPLICATOR

(75) Inventors: Richard Christopher Thorpe, Chislehurst (GB); G. Scott Desson, Bernardsville, NJ (US)

(73) Assignee: HCT Limited, Hong Kong (CN)

( * ) Notice: Subject to any disclaimer, the term of this patent is extended or adjusted under 35 U.S.C. 154(b) by 0 days.

(21) Appl. No.: 11/253,938

(22) Filed: Oct. 19, 2005

(65) Prior Publication Data

US 2006/0072963 A1 Apr. 6, 2006

Related U.S. Application Data

(63) Continuation-in-part of application No. 10/903,137, filed on Jul. 30, 2004.

(51) Int. Cl.

| | |
|---|---|
| ***A46B 11/04*** | (2006.01) |
| ***B05C 11/00*** | (2006.01) |
| ***A47L 13/30*** | (2006.01) |
| ***B43K 5/06*** | (2006.01) |

(52) U.S. Cl. ..... 401/277; 401/266; 401/263; 401/172; 401/174; 401/290; 401/269; 401/262

(58) Field of Classification Search ..... 401/171, 401/172, 174, 269, 270, 277, 290, 266, 265, 401/263, 262

See application file for complete search history.

(56) References Cited

U.S. PATENT DOCUMENTS

| | | | | |
|---|---|---|---|---|
| 499,612 A | | 6/1893 | Tower | |
| 660,677 A | | 10/1900 | Archer | |
| 1,340,043 A | | 5/1920 | Grace | |
| 1,362,937 A | | 12/1920 | Grace | |
| 1,498,439 A | | 6/1924 | Flom | |
| 2,199,877 A | | 5/1940 | Cervera | 221/79 |
| 2,214,144 A | | 9/1940 | Mureau | 15/137 |
| 2,272,641 A | | 2/1942 | Mureau | 15/137 |
| 2,287,321 A | | 6/1942 | Mureau | 15/137 |
| 2,309,861 A | | 2/1943 | Mureau | 15/137 |
| 3,002,517 A | | 10/1961 | Pitton | 132/85 |
| 3,468,612 A | | 9/1969 | Aston | 401/188 |
| 3,616,970 A | * | 11/1971 | Baumann et al. | 222/187 |
| 3,756,730 A | | 9/1973 | Spatz | 401/174 |
| 4,521,128 A | * | 6/1985 | O'Neal | 401/183 |
| 4,530,369 A | | 7/1985 | Adams | 132/84 |
| 4,903,868 A | | 2/1990 | Ichihara et al. | 222/257 |
| 4,957,125 A | | 9/1990 | Yaneza | 132/309 |
| 5,100,252 A | | 3/1992 | Podolsky | 401/174 |
| 5,454,660 A | | 10/1995 | Sakurai et al. | 401/266 |
| 5,803,640 A | | 9/1998 | Nakajima et al. | 401/174 |
| 5,827,002 A | | 10/1998 | Nakajima | 401/174 |
| 5,851,079 A | | 12/1998 | Horstman et al. | 401/174 |
| 6,155,735 A | | 12/2000 | Nakajima | 401/172 |
| 6,206,600 B1 | | 3/2001 | Rosenberg et al. | 401/272 |
| 6,213,662 B1 | * | 4/2001 | Aljanedi | 401/175 |
| 6,227,739 B1 | | 5/2001 | Kageyama | 401/172 |
| 6,474,891 B1 | | 11/2002 | Liu | 401/174 |
| 6,609,848 B1 | | 8/2003 | Rosenberg | 401/148 |

* cited by examiner

*Primary Examiner*—David J. Walczak

(57) ABSTRACT

A twist up pen type dispenser comprising a brush applicator that is capable of receiving material from a reservoir.

16 Claims, 8 Drawing Sheets

TWIST UP PEN TYPE DISPENSER WITH BRUSH APPLICATOR

CROSS-REFERENCE TO RELATED APPLICATION

This is a continuation-in-part application of U.S. patent application Ser. No. 10/903,137 filed Jul. 30, 2004, currently pending. U.S. patent application Ser. No. 10/903,137 is incorporated herein in its entirety by reference.

BACKGROUND OF THE INVENTION

The invention pertains to a twist up pen type dispenser comprising a brush applicator, such as an applicator with a brush applicator top surface having a smooth surface for applying material, which is capable of receiving material from a reservoir. In an embodiment of the invention, the brush applicator of the twist up pen type dispenser has a plurality of protrusions, such as at the brush applicator top surface, for brushing teeth.

SUMMARY OF THE INVENTION

The twist up pen type dispenser with brush applicator comprises a body having an annular space, an end cap, a nozzle section having a nozzle section body and a nozzle element, a brush applicator having a brush applicator top, which may have a brush applicator top surface having a smooth surface or the brush applicator top surface may have a plurality of protrusions, and a cover. Material, such as a dentifrice composition, can be stored in the annular space. The brush applicator comprises a pinhole which is capable of being engaged with the nozzle, particularly a nozzle opening at the tip of the nozzle. The cover, which can be releasably secured and thus removable has a cover protrusion. When the cap is secured, the cover protrusion is engaged with the pinhole and/or the nozzle opening to seal or substantially seal the material from the external environment.

Mechanical means within the dispenser may be applied to move the material from the annular space through the nozzle and deposit the material on the brush applicator through the pinhole. Because the cover protrusion seals or the substantially seals the material from the external environment, the material is isolated from any deleterious affects that the environment may have on the material, such as spoilage, drying, hardening and the like.

The engagement of the cover protrusion with the nozzle opening and/or the pinhole also prevents material from flowing out of the twist up pen type dispenser with brush applicator while not in use, thus making the device particularly portable especially for less viscous materials, such as a tooth cleaning gel or eyeliner.

In an embodiment of the invention, the twist up pen type dispenser with brush applicator has a dentifrice composition contained in the annular space and the brush applicator has one or more brush protrusions for brushing human or animal teeth. Dentifrice compositions that may be used in this embodiment include tooth gel, tooth paste, mouthwashes, mouth rinses, tooth whiteners and combinations thereof. This embodiment provides a handy portable tooth brush having a relatively narrow body that can be easily stored in smaller bags, such as a handbag, pouch, fanny pack, backpack and the like, without the material spoiling, hardening, drying out, or flowing out of the twist up pen type dispenser with brush applicator while the device is not being used. In a further embodiment of the invention, the brush applicator does not have any protrusions, but rather is an applicator with a brush applicator top surface having a smooth surface for applying material to a person or other animal.

DETAILED DESCRIPTION OF THE DRAWINGS

DETAILED DESCRIPTION OF THE INVENTION

Figure 2:
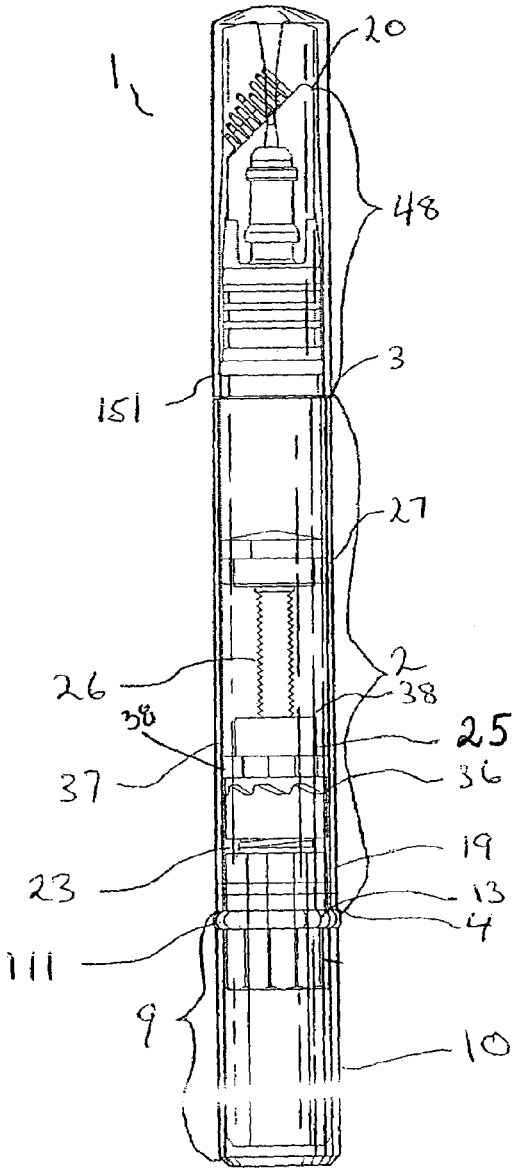
FIG. 2 is a side elevational view of the twist up pen type dispenser with brush applicator showing the cover in a closed position covering the brush applicator in an embodiment of the invention wherein the brush applicator has a brush applicator top with a brush applicator top surface comprising a plurality of protrusions.
Figure 3:
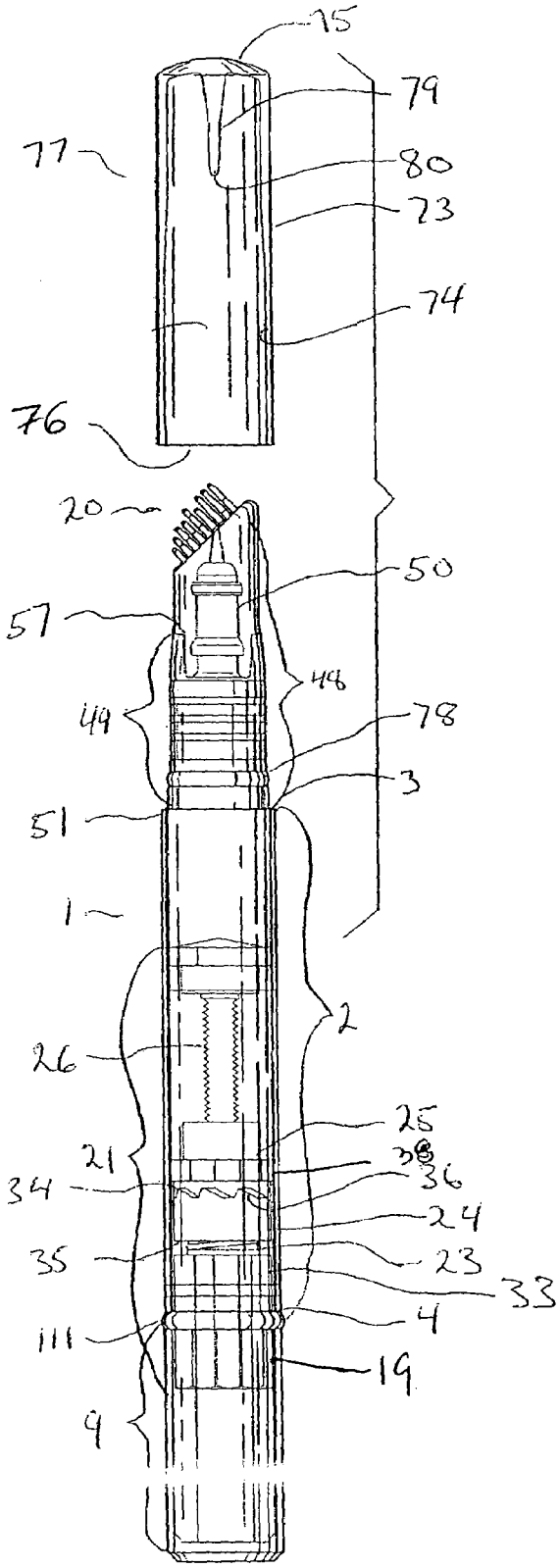
FIG. 3 is a side elevational view of the twist up pen type dispenser with brush applicator showing the cover in an open position in an embodiment of the invention wherein the brush applicator has a brush applicator top with a brush applicator top surface comprising a plurality of protrusions.
Figure 4:
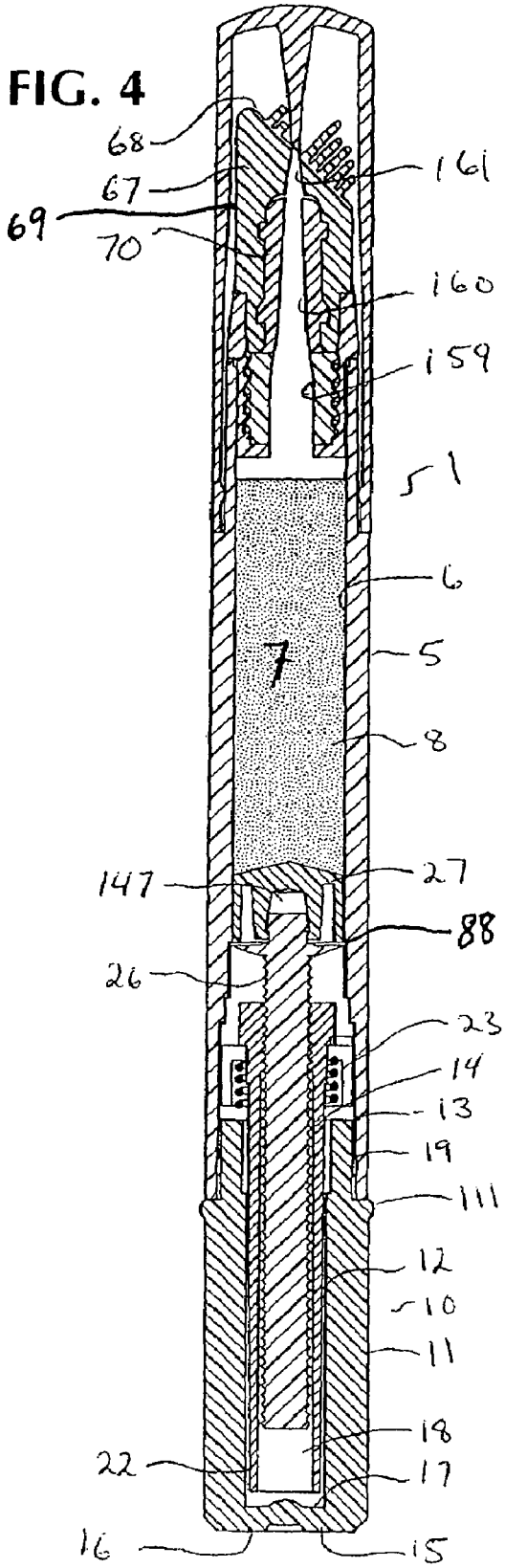
FIG. 4 is a cross sectional view of the twist up pen type dispenser with brush applicator showing a cap in a closed position covering the brush applicator in an embodiment of the invention wherein the brush applicator has a brush applicator top with a brush applicator top surface comprising a plurality of protrusions.
Figure 5:
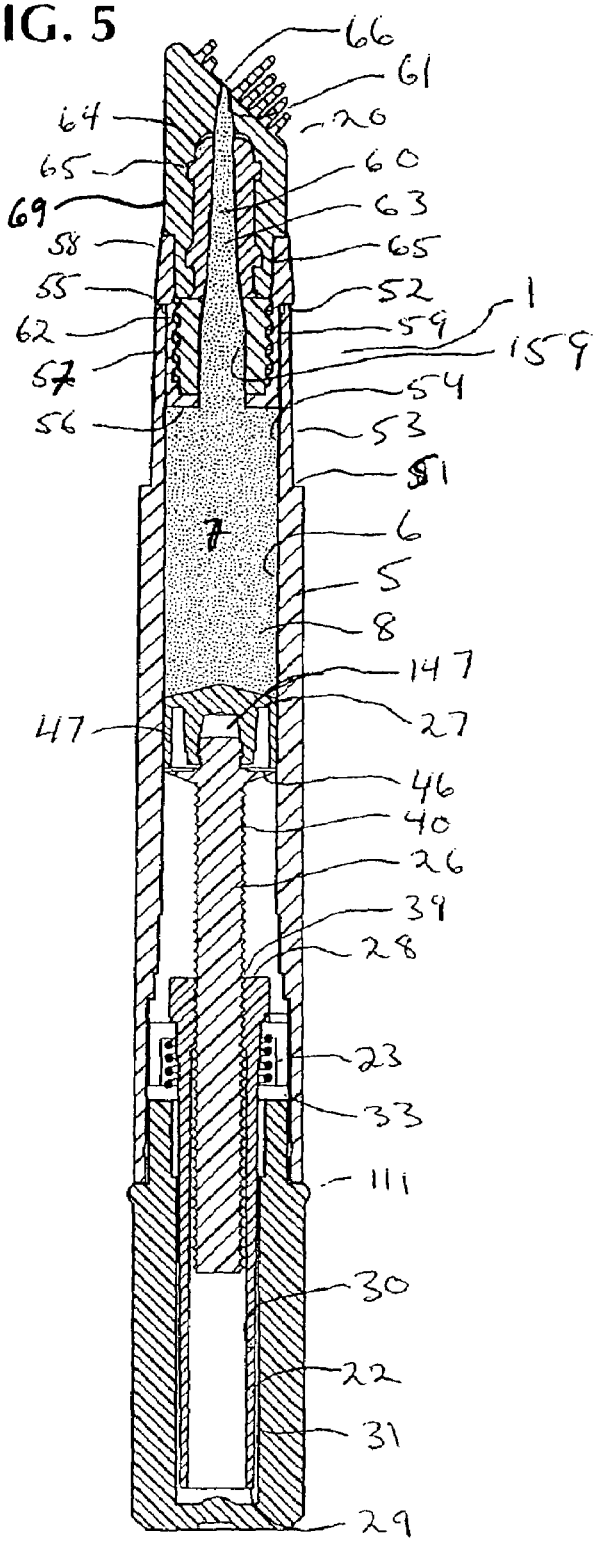
FIG. 5 is a cross sectional view of the twist up pen type dispenser with brush applicator showing the cap in an open position in an embodiment of the invention wherein the brush applicator has a brush applicator top with a brush applicator top surface comprising a plurality of protrusions.

As shown in FIGS. 2-5 and in FIG. 10-13, the twist up pen type dispenser with brush applicator 1 comprises a body 2, preferably substantially in the shape of a cylinder, having a top 3, a bottom 4, an outer surface 5 and an inner surface 6 which defines an annular space 7. As shown in FIGS. 4 and 5 and also in FIGS. 12 and 13, material 8 may be within the annular space 7, which functions as a reservoir for the material 8 within the twist up pen type dispenser with brush applicator 1. The material 8 may be a dentifrice, such as tooth gel, tooth paste, mouthwash, mouth rinse, tooth whitener and combinations thereof, cosmetics, such as mascara and eyeliner, hair similar materials, or skin treatment compositions, combinations thereof, and the like.

Again referring to FIGS. 2-5, the twist up pen type dispenser with brush applicator 1 further comprises an end cap 9, preferably substantially in the shape of the cylinder, having a continuous lateral side 10 with an outer surface 11 and an inner surface 12, an end cap top 13 having an end cap opening 14 and an end cap bottom 15 with an outer surface 16 and an inner surface 12, the end cap having a cavity 18 defined by the inner surface 12 of the continuous lateral side 10 and the inner surface 17 of the end cap bottom 15. The end cap top 13 is adjacent to the bottom 4 of the body 2 with the end cap opening 14 and cavity 18 about aligned with the annular opening 7 of the body 2. As shown in FIGS. 2-5, the outer surface 11 of the end cap 9 may have a continuous protrusion 111 at about the end cap top 13. Also, the inner surface 17 of the end cap 9 may have a plurality of sequential and adjacent polygonal surfaces 19, such as rectangular surfaces. As shown in FIGS. 4 and 5, the polygonal surfaces may protrude within the annular opening 7 being opposite the inner surface 6 of the body 2 at about the bottom 4 of the body 2. The end cap is preferably capable of rotation. The end cap and/or body may be made of clear or opaque plastic material which permits portability without risk of breakage and allows a user to see the amount of material 8 remaining in the annular space 7.

The twist up pen type dispenser with brush applicator 1 further comprises means 21 for moving the material 8 from the annular space 7 to a brush applicator 20. As shown in the embodiment depicted in FIGS. 2-5 and in FIGS. 10-13, the means 21 comprises a driving rod 22, a compression spring 23, a ratchet wheel 24, a securing seat 25, a piston rod 26 and a piston 27. As shown in FIGS. 4 and 5 and also in FIGS. 12 and 13, the driving rod 22 has a top 28, bottom 29, an inner surface 30 and an outer surface 31. The bottom 29 of the of the driving rod 22 is inserted into the end cap bottom and is held into place by the polygonal surfaces 19 such that as the end cap rotates the driving rod is driven to rotate which causes the piston rod 26 and piston 27 to move through the annular space 7.

As shown in the drawings, particularly FIGS. 2-5, a continuous shelf 33 is located on the inner surface 6 of the body proximate to the bottom 4 of the body 2. The ratchet wheel 24 has a top 34 and a bottom 35 and comprises a plurality (e.g. a ring) of teeth 36 at the top 34. The compression spring 23 is mounted to the outer surface of the driving rod between the bottom 35 of the ratchet wheel and the continuous shelf 33 and facilitates movement of the ratchet wheel 24.

The securing seat 25 is above the ratchet wheel. The securing seat 25 has a top 43 and a bottom 41 and there are a plurality of teeth 39 (e.g. a ring of teeth) at the bottom 41 of the securing seat. The seat further has a circumferential edge 37 which is provided with securing engagement edge 38 of polygonal shape on the inner surface of the body for mounting within the annular opening 7 of the body 2. The securing seat 25 further comprises a hole 39 at about the center running from the top 43 to the bottom allowing the piston rod 26 to pass through. As shown in FIGS. 2-5, the top 43 of the securing seat 25 may be smaller in dimension, e.g., have a smaller diameter in the axial direction than the bottom 34 of the securing seat 25.

The piston rod 26 is threaded with screw threads 40 for mounting to the inner surface 30 of the driving rod 22. The inner surface 30 of the driving rod 22 may also have screw threads. The piston rod is secured at the top of the piston rod to the piston 27. As shown in FIGS. 4 and 5, the top of the piston rod 26 is provided with an engaging block 46 having a continuous outer protrusion 47 and a center protrusion 147 to engage with the piston 27. The continuous outer protrusion 47 is proximate to the outer edge of the engaging block 46 and the center protrusion 147 corresponds to the piston rod 26.

The piston 27 is located in the annular space 7 of the body 2. The bottom 88 of the piston interfaces with the engaging block 46 and, as shown in FIGS. 4 and 5 the continuous outer protrusion 47 and center protrusion 147 protrude within the piston 27 thus securing the piston 27 to the engaging block 46 and thus the piston rod 26. The piston may be any geometric shape, such as a disc with a flat top and bottom, but is shown in FIGS. 4 and 5 as having a conical shape, such as a crown top. The conical shape maximizes removal of the material 8 from the annular opening 7. The piston 27 may be made from silicone or similar type plastic material.

Referring to FIGS. 2-5, when the end cap 10 rotates counterclockwise, the driving rod 22 will drive the ratchet wheel 24 to rotate counterclockwise. At the same time, the piston 27 will move upward within the annular space 7 as a result of the piston rod 26 being driven by the driving rod 22. The material 8 is on the top of the piston 27 and is squeezed upwards to the nozzle section 48. When the ratchet wheel 24 rotates counterclockwise, the teeth 36 will not move for the reason that the securing seat 25 is secured to the body 2. The sloping face of the teeth 36 of the ratchet wheel 24 will move along the corresponding sloping face of the teeth 39 of the securing seat 25 so that the ratchet wheel 24 will be lowered and compress the compression spring 23 until the teeth 36 of the ratchet wheel 24 are moved to the teeth 33 of the securing seat 34 (i.e., the sloping face of the teeth 36 of the ratchet wheel 24 are engaged with the sloping face of the teeth 33 of the securing seat 25 displaced by one tooth 33 section in the counterclockwise direction). At this instance, the ratchet wheel 24 will restore to its original position by the spring force of the compression spring 23.

In the original position, the teeth 36 of the ratchet wheel 24 are mutually opposed to the teeth 39 of the securing seat 25, such that the teeth are mutually engaging, so that reverse direction (e.g., clockwise direction) of the ratchet wheel will not be possible. The piston 27 defines the lower edge of the material 8 within the annular space 7. Because reverse direction of the ratchet wheel is not possible, the piston 27 is effectively unidirectional and thus the material will always move toward the top 3 of the body 2. This precludes material 8 and, in part, prevents material 8, from entering portions of the annular space 7 behind the advancement of the piston 27 and contacting the other elements of the means for moving the material. This aspect of the invention facilitates the function of the device.

U.S. Pat. No. 6,474,891 describes a material-extracting device for a pen type make up dispenser. This material-extracting device can be used with the twist up pen type dispenser with brush applicator as described herein. U.S. Pat. No. 6,747,891 is incorporated herein in its entirety by reference.

The twist up pen type dispenser with brush applicator 1 further comprises a nozzle section 48. As shown in FIGS. 2-5, the nozzle section comprises a nozzle section body 49 and a nozzle element 50. The nozzle section body is generally cylindrical having a nozzle section body bottom 51, nozzle section body top 52, a nozzle section body outer surface 53 and a nozzle section body inner surface 54 and is adjacent to the top 3 of the body 2. The nozzle section further comprises a sheath 55 having a bottom plate 56, a middle wall 57 and a top wall 58. The top wall 58 of the sheath 55 is adjacent to the nozzle section body top 52 and protrudes inwards from the nozzle section body top 52 adjacent to the middle wall 57 which is opposed to the nozzle section body inner surface 54. The middle wall 57 terminates at the bottom plate 56 which protrudes from the nozzle section body inner surface, preferably at an angle of about 90°, at some point between the nozzle section body bottom 51 and nozzle section body top 52. As shown in FIGS. 2-3, the nozzle section body outer surface 53 near the nozzle section body bottom 51 may have one or more protrusions 78 for engaging the cover 77.

As shown in FIGS. 2-5 and in FIGS. 10-13, the nozzle element 50 comprises a base section 59, nozzle mid section 60 and a tip 61. The base section 59 is cylindrical and has a base section outer wall 62 that has a plurality of protrusions which secure the nozzle element to the nozzle section body. The nozzle section body 49 is either attached to the body 2 or is integral with the body 2. The nozzle element base section 59 has a base section inner surface 159 which may be tapered that defines all or part of a nozzle annular space 63 that is continuous through the base section 59, mid section 60 and tip 61. The nozzle mid section 60 has an outer wall 64 that may have one or more protrusions 65 for engaging the brush applicator 20 and a mid section inner surface 160 which may be tapered that defines all or part of a nozzle part annular space 63. The tip 61 is a tapered element having a nozzle opening 66 at the end opposite the mid section 60. The tip has a tip inner surface 161 which may be tapered that defines all or part of a nozzle part annular space 63.

Figure 6:
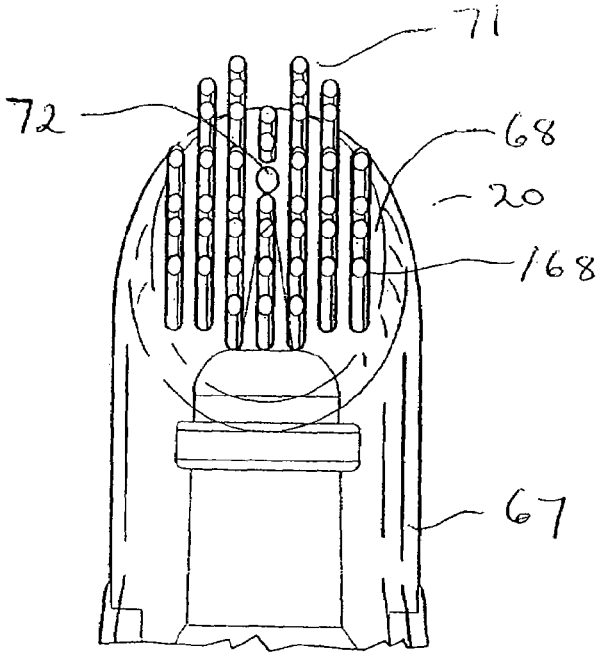
FIG. 6 is a front view of the brush applicator engaged with the nozzle section in an embodiment of the invention wherein the brush applicator has a brush applicator top with a brush applicator top surface comprising a plurality of protrusions.
Figure 7:
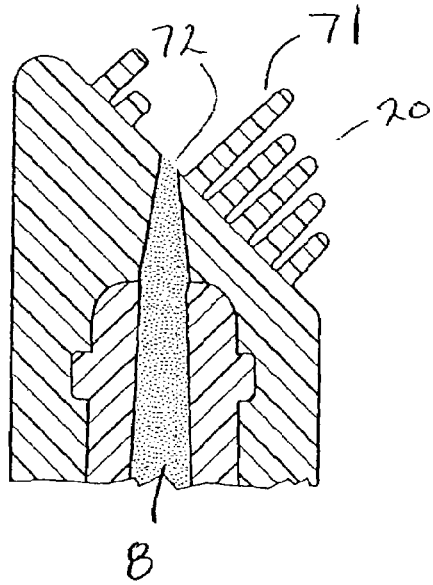
FIG. 7 is a cross sectional view of the brush applicator engaged with the nozzle section with material in the nozzle in an embodiment of the invention wherein the brush applicator has a brush applicator top with a brush applicator top surface comprising a plurality of protrusions.
Figure 8:
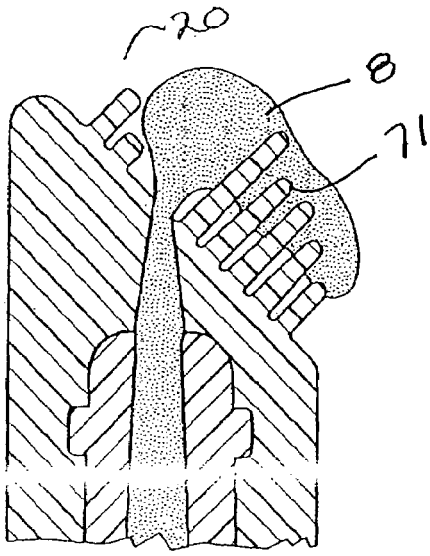
FIG. 8 is a cross sectional view of the brush applicator engaged with the nozzle section with material in the nozzle and on the brush applicator top surface in an embodiment of the invention wherein the brush applicator has a brush applicator top with a brush applicator top surface comprising a plurality of protrusions.

The twist up pen type dispenser with brush applicator 1 further comprises the brush applicator 20, which is shown in the drawings and in particular FIGS. 6-8. The brush applicator 20 comprises a brush applicator base 67 which is generally a cylindrical sleeve having a hollow inner section for engaging the nozzle section 48, and a brush applicator top 68. The brush applicator base 67 has an outer surface 69 and an inner surface 70 with the inner surface 70 defining the sleeve. The sleeve is capable of engaging the outer wall 64 of the nozzle mid section 61 and the top wall 58 of the sheath 55 such that the brush applicator can be secured to or releasably secured to the nozzle element. The bottom of the brush applicator base 67 has an opening defined by the inner surface 70. The brush applicator top 68 may be angled and has a brush applicator top surface 168 having one or more brush protrusions 71 and a pinhole 72. As shown in FIGS. 6-8, when the brush applicator 20 is releasably secured to the nozzle, the nozzle opening 66 is engaged with the pinhole 72. The brush applicator 20 may be a single piece made of silicone, such as injection molded silicone, or similar type material.

As shown in FIGS. 2-4 and 10-11, the twist up pen type dispenser with brush applicator 1 also comprises a cover 77, preferably substantially in the shape of a cylinder, having a cover outer surface 73, a cover inner surface 74 and a cover top 75 with an inner and outer surface. The cover has a cover opening 76 at the end opposite the cover top 75. The cover inner surface 74 and the inner surface of the cover top defines a cavity so that the cover can be placed over the nozzle element and brush applicator with the cover inner surface 74 engaging the nozzle section body outer surface 53, such as the one or more protrusions 78 near the nozzle section body bottom 51. In this manner the cover can be replaceably secured to the twist up pen type dispenser with brush applicator.

As shown in FIGS. 2-4 and 10-11, the cover further comprises a cover protrusion 79 emanating from the inner surface of the cover top 75, generally from about the center of the inner surface of the cover. The protrusion 79 may be tapered and has a protrusion tip 80 at the end opposite the dover top 75. When the cover is releasably secured to the twist up pen type dispenser with brush applicator 1, the protrusion tip 80 is engaged with the pinhole 72 and/or the nozzle opening 66. As such, the engagement of the nozzle opening, pinhole and cover protrusion effectively seals the material from the external environment when the twist up pen type dispenser with brush applicator 1 is not in use. The cover top 75 may further comprise one or more holes (not shown) to allow ambient air onto the brush applicator. The cover may be made of a clear plastic material.

Figure 15:
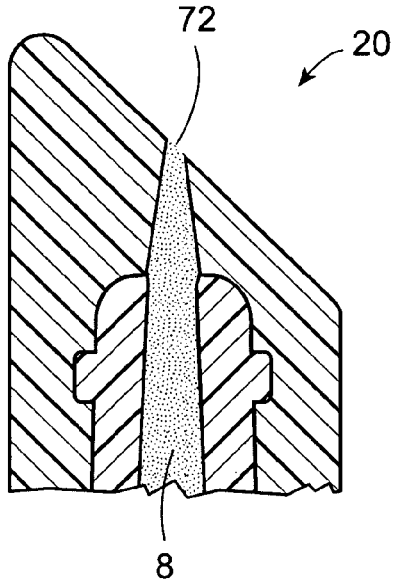
FIG. 15 is a cross sectional view of the brush applicator engaged with the nozzle section with material in the nozzle in an embodiment of the invention wherein the brush applicator has a brush applicator top with a brush applicator top surface having a smooth surface.
Figure 16:
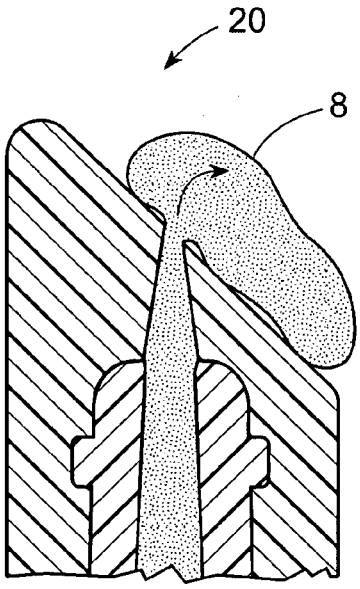
FIG. 16 is a cross sectional view of the brush applicator engaged with the nozzle section with material in the nozzle and on the brush applicator top surface in an embodiment of the invention wherein the brush applicator has a brush applicator top surface having a smooth surface.

The material 8 in the twist up pen type dispenser with brush applicator 1 is stored for use in the annular space 7 of the body 2. When a person desires to use the twist up pen type dispenser with brush applicator, the user removes the cover 78 and rotates the end cap 10 thereby causing the driving rod 22 to drive the ratchet wheel 36 to rotate thus moving the piston 27 upward within the annular opening 7 as a result of the piston rod 26 being driven by the driving rod 22 thereby forcing some or all of the material 8 from the annular space 7 to the nozzle section 48. The pressure caused by the piston on the material 8 forces the material 8 through the nozzle part annular space 63 to the nozzle opening 66 and through the nozzle opening and pinhole 72 thereby depositing the material on the brush applicator top 68, as shown on FIGS. 7 and 8 and also in FIGS. 15 and 16. When sufficient material is on the brush applicator top, the user simply stops rotating the end cap 10. After use, the user replaces the cover 78 on the twist up pen type dispenser with brush applicator 1 which, as discussed above, seals the material from the external environment.

Figure 1:
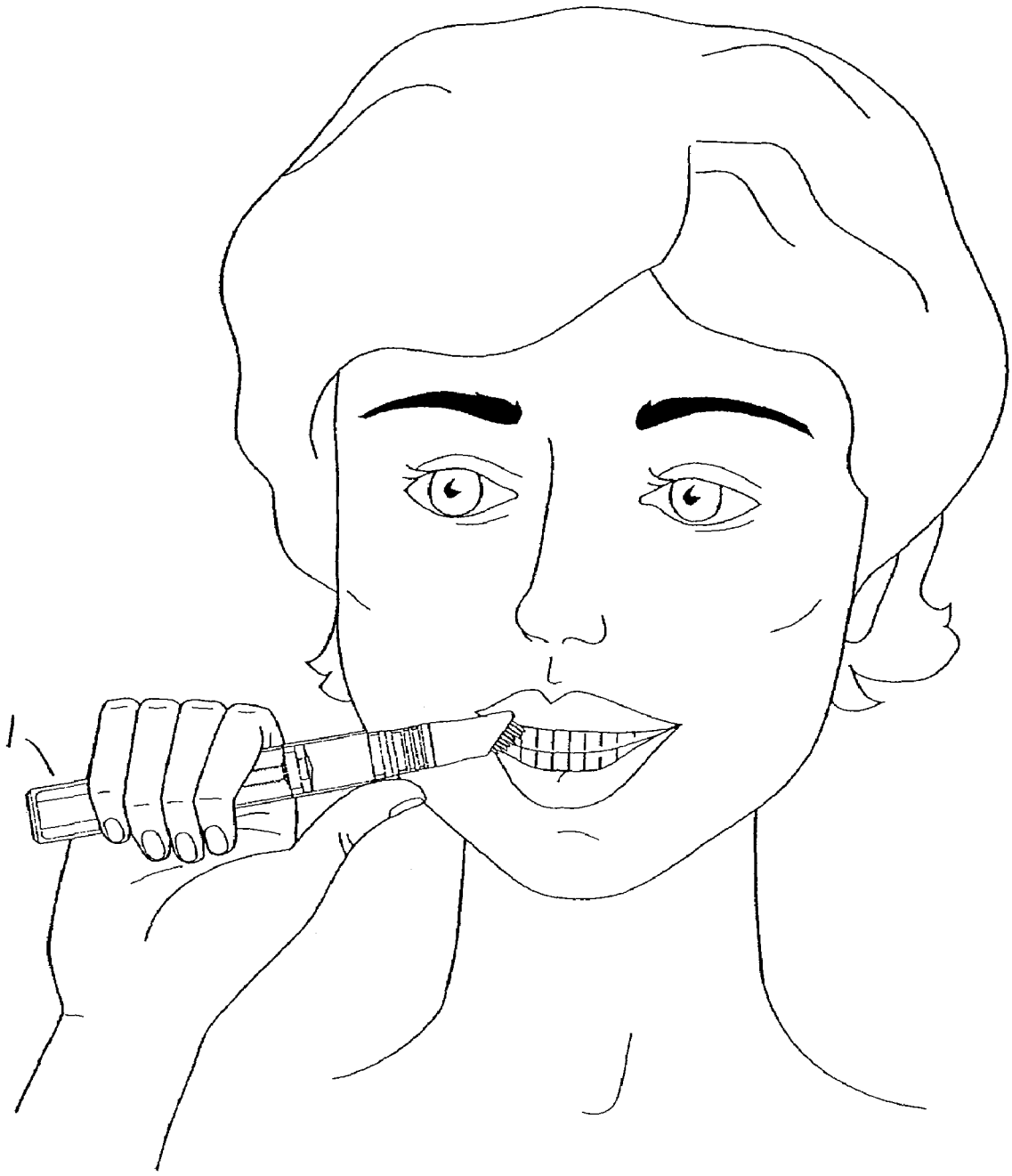
FIG. 1 is a perspective drawing of a person using the twist up pen type dispenser with brush applicator for brushing teeth in an embodiment of the invention wherein the brush applicator has a brush applicator top with a brush applicator top surface comprising a plurality of protrusions.
Figure 9:
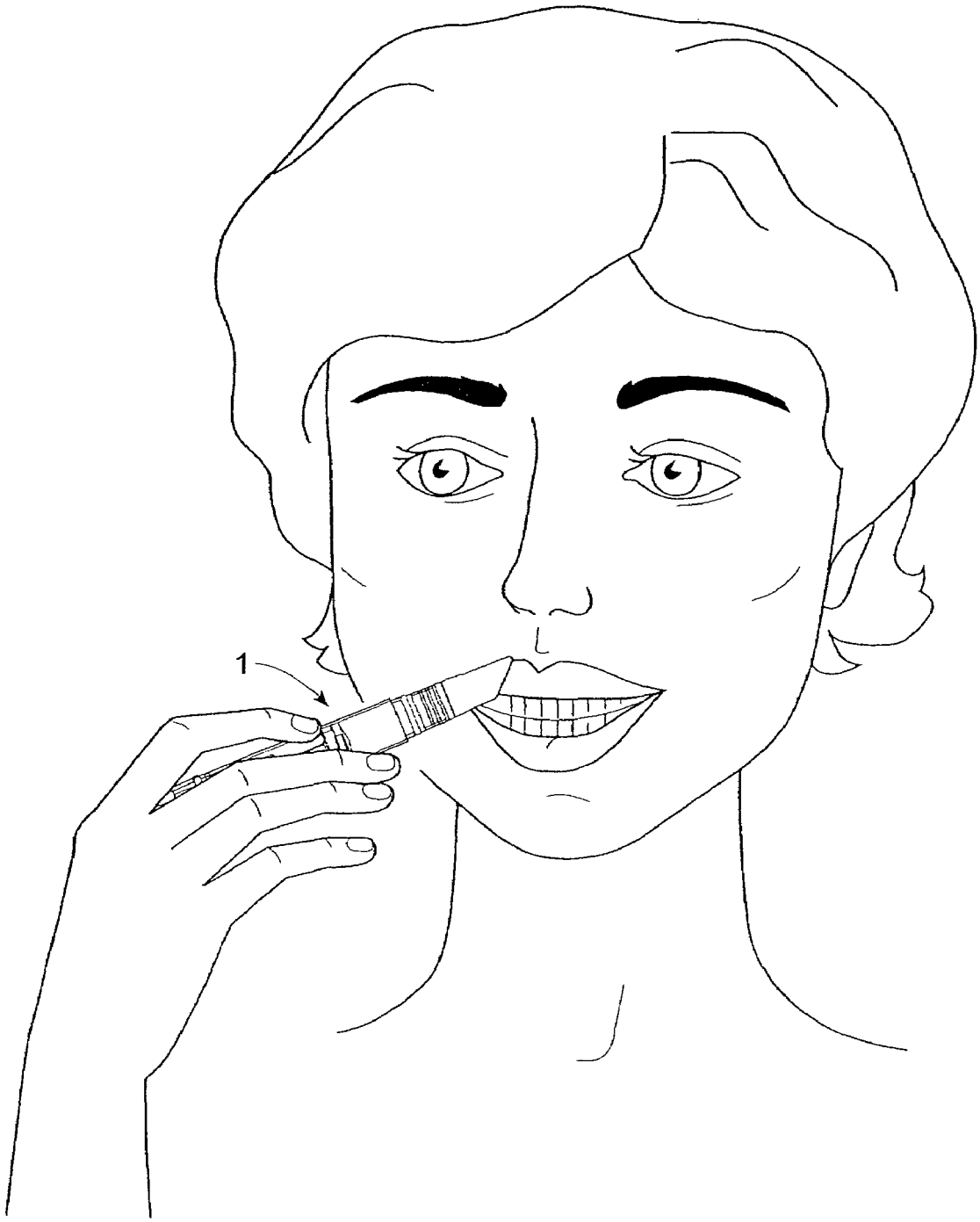
FIG. 9 is a perspective drawing of a person using the twist up pen type dispenser with brush applicator to apply material to the lips in an embodiment of the invention wherein the brush applicator has a brush applicatior top with a brush applicator top surface having a smooth surface.
Figure 10:
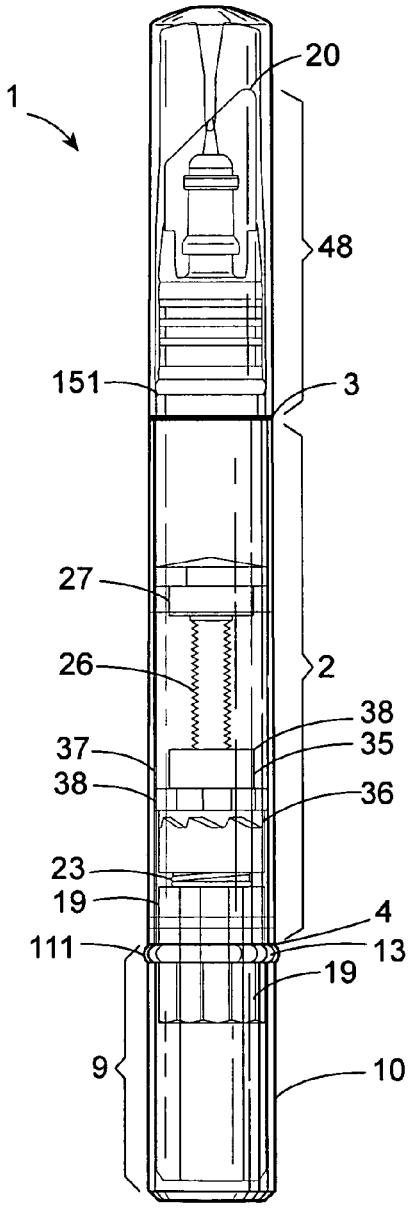
FIG. 10 is a side elevational view of the twist up pen type dispenser with brush applicator showing the cover in a closed position covering the brush applicator in an embodiment of the invention wherein the brush applicator has a brush applicator top with a brush applicator top surface having a smooth surface.
Figure 11:
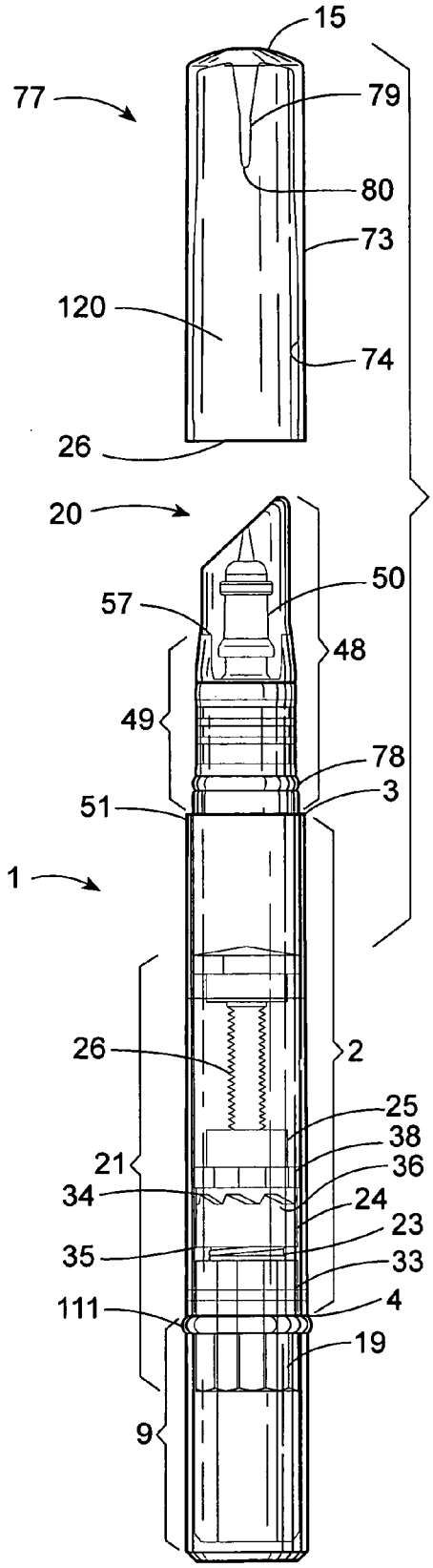
FIG. 11 is a side elevational view of the twist up pen type dispenser with brush applicator showing the cover in an open position in an embodiment of the invention wherein the wherein the brush applicator has a brush applicator top with a brush applicator top surface having a smooth surface.
Figure 12:
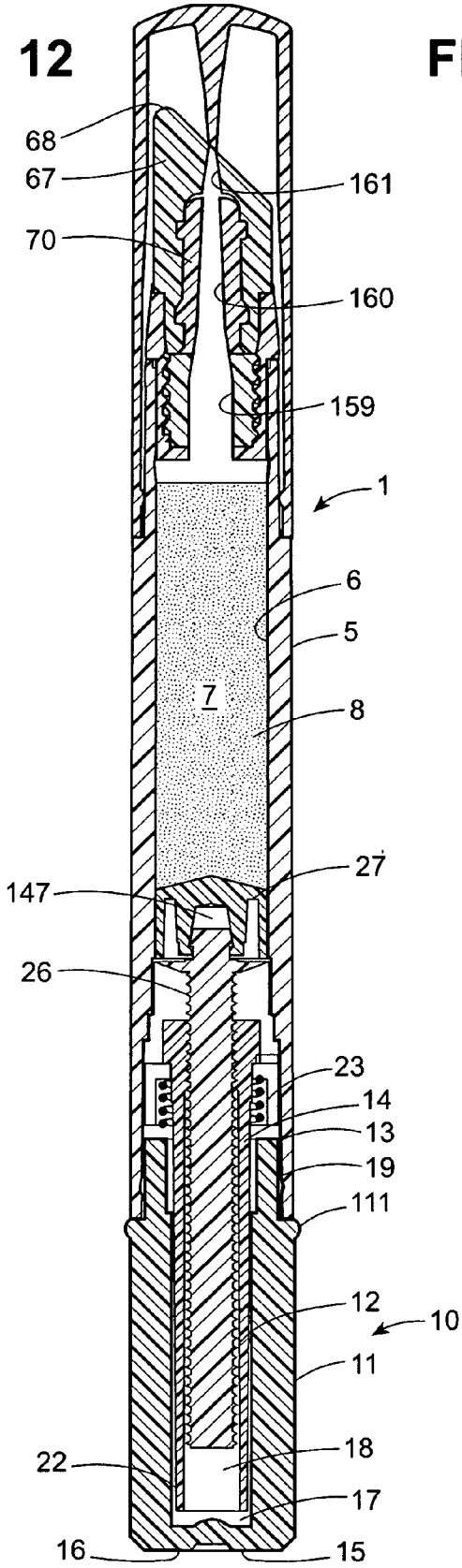
FIG. 12 is a cross sectional view of the twist up pen type dispenser with brush applicator showing a cap in a closed position covering the brush applicator in an embodiment of the invention wherein the brush applicator has a brush applicator top with a brush applicator top surface having a smooth surface.
Figure 13:
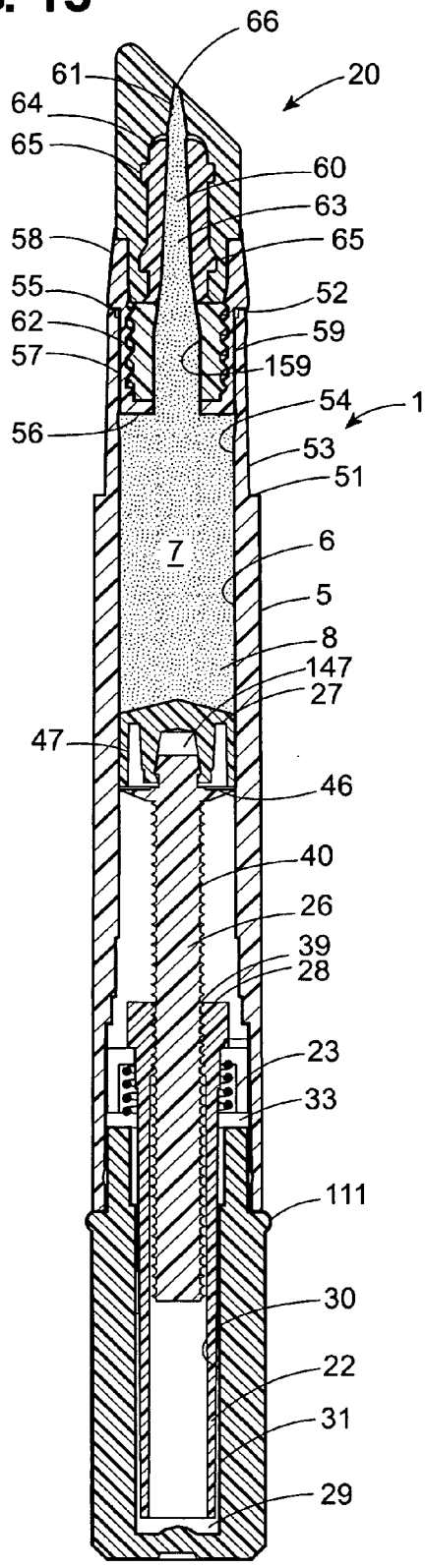
FIG. 13 is a cross sectional view of the twist up pen type dispenser with brush applicator showing the cap in an open position in an embodiment of the invention wherein the brush applicator has a brush applicator top with a brush applicator top surface having a smooth surface.
Figure 14:
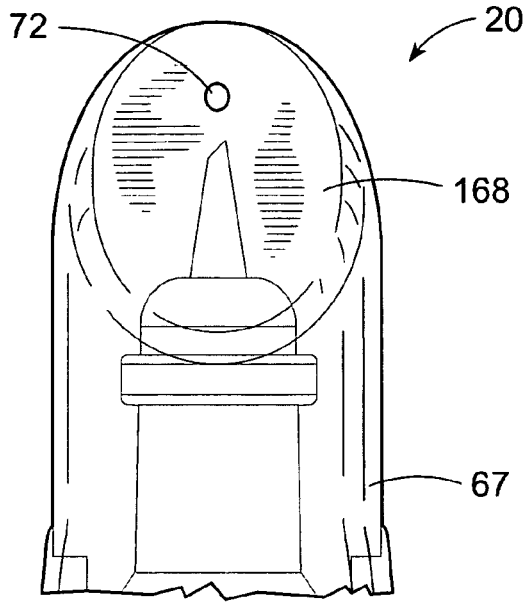
FIG. 14 is a front view of the brush applicator engaged with the nozzle section in an embodiment of the invention wherein the brush applicator has a brush applicator top with a brush applicator top surface having a smooth surface.

In an embodiment of the invention, as shown in FIG. 1, the twist up pen type dispenser with brush applicator 1 is used as a portable tooth brush and in the embodiment of the invention shown in FIG. 9 the twist up pen type dispenser with brush applicator 1 comprises a brush applicator 20 having a smooth brush applicator top surface 168 and is used to apply material, such as lip gloss or lip balm or other lip protecting or medical substance to the lips. Although the twist up pen type dispenser with brush applicator 1 is shown in FIG. 1 as a toothbrush and in FIG. 9 to apply material to the lips, it should be understood that these are depictions of a few of many uses or embodiments for the twist up pen type dispenser with brush applicator. Another use, for example, can be as an applicator for darkening facial hair, such as a moustache, wherein the material 8 is hair darkener and can be applied to the moustache by depositing the hair darkener on the brush applicator top and then engaging the brush applicator top with the moustache, such as stroking the brush protrusions through the moustache hairs.

We claim:

1. A dispenser comprising a) a body comprising a top, a bottom, an outer surface and an inner surface which defines an annular space;

b) an end cap comprising a continuous lateral side with an outer surface and an inner surface, an end cap top having an end cap opening and an end cap bottom with an outer surface and an inner surface, the end cap having a cavity defined by the inner surface of the continuous lateral side and the inner surface of the end cap bottom wherein the end cap top is adjacent to the bottom of the body and the end cap is capable of rotation;

c) a nozzle section comprising i) a nozzle section body with a nozzle section body bottom, nozzle section body top, a nozzle section body outer surface and a nozzle section body inner surface wherein the nozzle section body is adjacent to the top of the body; and ii) a nozzle element having a base section with a base section inner surface, a nozzle mid section with a mid section inner surface and a tip with a tip opening and a tip inner surface wherein the base section inner surface, mid section inner surface and tip inner surface define a nozzle annular space;

d) a brush applicator comprising a brush applicator base and a brush applicator top wherein i) the brush applicator base has an outer surface and an inner surface which defines a sleeve;

ii) the brush applicator base further has an opening defined by the brush applicator inner surface;

iii) the brush applicator top has a brush applicator top surface having a pinhole; and iv) the brush applicator is capable of being secured to or releasably secured to the dispenser such that the pinhole is engaged with the tip of the nozzle element at the tip opening;

e) a cover comprising a cover outer surface, a cover inner surface and a cover top with an inner surface and an outer surface wherein i) the cover inner surface and inner surface of the cover top define a cavity;

ii) the cover further comprises a cover opening at the end of the cover opposite the cover top;

iii) the inner surface of the cover top comprises a cover protrusion emanating from the cover inner surface into the cavity wherein the cover is capable of being releasably secured over the brush applicator with the cover protrusion engaged with the pinhole, tip opening or combinations thereof; and f) a means for moving material from the annular space to the brush applicator comprising, said means comprising:

i) a driving rod comprising a top, a bottom, an inner surface and an outer surface wherein the bottom is inserted into the cavity of the end cap and secured to the end cap;

ii) a piston rod comprising screw threads and an engaging block wherein the screw threads are mounted to the inner surface of the driving rod;

iii) a ratchet wheel and a securing seat having mutually engaging teeth;

iv) a piston located in the annular space which interfaces with the engaging block; and v) a compression spring.

2. The dispenser of claim 1 wherein brush applicator top surface is smooth.

3. The dispenser of claim 1 wherein the brush applicator top surface comprises a plurality of protrusions.

4. The dispenser of claim 3 which is a portable toothbrush.

5. The dispenser of claim 1 wherein the inner surface of the body comprises a continuous shelf and the compression spring is mounted to the outer surface of the driving rod between the ratchet wheel and the continuous shelf.

6. The dispenser of claim 1 wherein driving rod is secured to the end cap by polygonal surfaces on the inner surface of the end cap.

7. The dispenser of claim 1 wherein the inner surface of the driving rod has screw threads.

8. The dispenser of claim 1 wherein the piston rod has a continuous outer protrusion and a center protrusion for engaging the piston.

9. The dispenser of claim 1 wherein the securing seat is mounted to the body within the annular space by a securing engagement edge on the inner surface of the body.

10. The dispenser of claim 1 wherein the piston is silicone.

11. The dispenser of claim 1 wherein the outer surface of the end cap has a continuous protrusion at about the end cap top.

12. The dispenser of claim 1 wherein the end cap is made of clear or opaque plastic material.

13. The dispenser of claim 1 wherein the body is made of clear or opaque plastic material.

14. The dispenser of claim 1 wherein the nozzle section body bottom comprises one or more protrusions.

15. The dispenser of claim 1 wherein the base section of the nozzle element has a base section outer wall with a plurality of protrusions.

16. The dispenser of claim 1 wherein the brush applicator is silicone.

* * * * *